US005772083A

United States Patent [19]

Joulia

[11] Patent Number: 5,772,083

[45] Date of Patent: Jun. 30, 1998

[54] PRESSURE RELIEF SYSTEM FOR PRESSURIZED CONTAINER

[75] Inventor: Gerard Joulia, Paris, France

[73] Assignee: L'Oreal, Paris, France

[21] Appl. No.: 721,381

[22] Filed: Sep. 26, 1996

[30] Foreign Application Priority Data

Sep. 26, 1995 [FR] France ..... 95 11277

[51] Int. Cl.[6] ..... F16K 17/02

[52] U.S. Cl. ..... 222/396; 222/95; 222/325; 222/386.5

[58] Field of Search ..... 222/95, 105, 386.5, 222/389, 394, 396, 397, 325

[56] References Cited

U.S. PATENT DOCUMENTS

| | | | |
|---|---|---|---|
| 3,658,208 | 4/1972 | Hansen | 222/396 X |
| 3,912,130 | 10/1975 | Pelton | 222/396 |
| 3,918,611 | 11/1975 | Ewald | 222/396 |
| 4,646,947 | 3/1987 | Stull | 222/397 |
| 5,179,982 | 1/1993 | Berube et al. | 141/20 |

FOREIGN PATENT DOCUMENTS

| | | |
|---|---|---|
| 4002580 | 8/1991 | Germany . |
| 4009705 | 10/1991 | Germany . |

*Primary Examiner*—Kevin P. Shaver
*Attorney, Agent, or Firm*—Oblon, Spivak, McClelland, Maier & Neustadt, P.C.

[57] ABSTRACT

A pressurized container contains a product to be dispensed and a propellant gas. The container includes a closed reservoir, a cylindrical neck, a dispensing head mounted on the neck and a safety device. The safety device can prevent an accidental excess pressure inside the container and includes an annular resilient retaining mechanism that surrounds the neck. The annular resilient retaining mechanism is capable of tightly gripping the dispensing head on the neck in a leakproof manner when an internal pressure of the reservoir is below a predetermined value. The annular resilient retaining mechanism is further capable of moving the dispensing head away from the neck so as to create a communication between an inside of the container and atmosphere when the internal pressure exceeds the predetermined value.

15 Claims, 1 Drawing Sheet

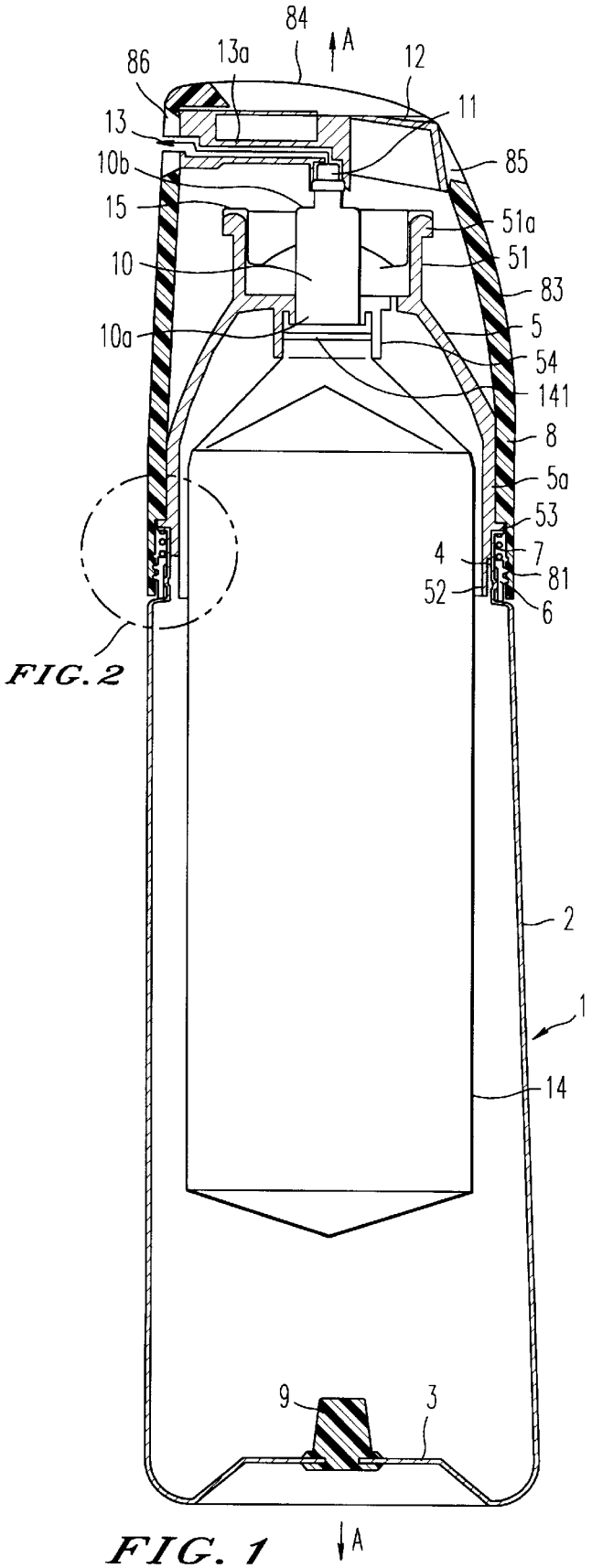
FIG. 2
FIG. 1
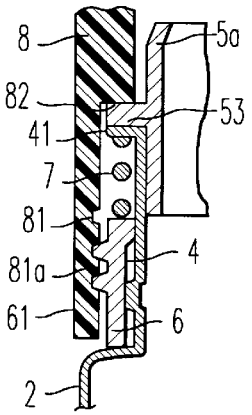
FIG. 2
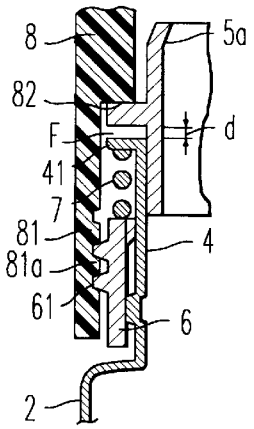
FIG. 3
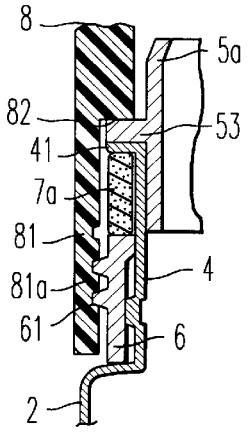
FIG. 4

PRESSURE RELIEF SYSTEM FOR PRESSURIZED CONTAINER

BACKGROUND OF THE INVENTION

1. Field of the Invention

The present invention relates to a container for dispensing a product, of a liquid or even gelled consistency, that is pressurized by means of a propellant gas, this dispenser having a safety device.

The dispensing container in accordance with the present invention, also called a dispenser, can be used in different fields of use, and may serve for the dispensing of cosmetic or pharmaceutical products, household products, paints etc., in the form of a liquid jet or of fine droplets.

More particularly, the invention relates to a dispenser that can be recharged, both with the liquid to be sprayed and with the propellant gas, comprising a reservoir and a dispensing valve for the liquid contained in the reservoir. The dispenser has a gas discharge system designed to prevent an accidental excess pressure inside the container.

2. Discussion of the Background

To allow it to be recharged, a dispenser of the kind defined above must be provided with a product reservoir which can be opened with a view to introducing into it a new refill of the product after the product initially contained in this reservoir has been used up. Once the new refill has been placed into position, and after the reservoir has been closed, it is then necessary to introduce the propellant gas into this reservoir. This may be effected by connecting the reservoir to a gas source such as a bottle containing a compressible or liquefiable gas or, of course, to a compressor producing compressed air. During the pressurization of the reservoir, in particular if it is effected by the user himself, it is difficult to control the internal pressure obtained in the reservoir. This pressure must not exceed a predetermined value, or the reservoir may burst or explode, and hence cause injuries to the user. Moreover, when such a dispenser is exposed to a source of heat, for example to the sun, excess pressure is produced inside it, also with the risk of causing the reservoir to burst.

FR-A-2 684 647 discloses a related pressurized non-rechargeable dispensing container, which contains a fluid product to be dispensed and a compressed propellant gas. To prevent an excess pressure greater than a predetermined pressure value inside the container, the container is provided with a gas-discharging device constituted by a stopper made of a deformable material and driven into an opening of the wall of the container. The stopper has a zone of lower strength due to a cutout arranged in the stopper. This zone of lower strength makes it possible to establish an ultimate communication between the inside of the container and the atmosphere when it is deformed under the effect of an excess pressure.

This dispenser of the related art has drawbacks when an excess pressure occurs inside the reservoir. Indeed, this excess pressure may cause the stopper and hence the whole of the propellant gas to be ejected and the dispensing of the product can no longer be effected. Moreover, when the dispenser is in a position where the product is in contact with the stopper, the excess pressure obtained in the reservoir may also cause the ejection of the stopper and of the product at the same time. This is detrimental, in particular if the dispenser is located at the time of the excess pressure in a suitcase, since all the contents of the suitcase are then in danger of being soiled by the product released.

FR-A-1 339 722 discloses a related dispenser for a pressurized liquid, having a safety device comprising a spring-loaded relief valve capable of automatically closing again after allowing an excess of propellant gas to escape. This dispenser is not designed to be rechargeable.

EP A-0 028 032 discloses a related rechargeable pressurized container which does not have a safety device to operate in the case of an internal excess pressure.

SUMMARY OF THE INVENTION

An object of the present invention is therefore to remedy the above mentioned drawbacks and in particular, to propose a dispensing container having a safety device. That is, the present invention provides-for a gas discharge device, with the aim of preventing internal excess pressures. The dispensing device is, in particular, rechargeable with propellant and with the product. The product can be a hair lacquer or an alcohol body lotion. Moreover, when it is rechargeable, the container of the invention has the advantage that only a portion of its component parts has to be disposed of after the product has been used up, it being possible for the other portion of its components to be reused with a new refill. This solution is particularly economical. Moreover, the rechargeable dispensing container in accordance with the invention can be manufactured at a lower cost than those of the related art.

The present invention therefore provides for a dispensing container for the dispensing of a product comprising : a closed reservoir; a cylindrical neck; a dispensing head mounted on the neck; and a safety device for preventing an accidental excess pressure inside the container. The safety device comprises resilient annular retaining means surrounding the neck of the reservoir, capable of tightly gripping the dispensing head on the neck of the reservoir in a leakproof manner when the internal pressure of the reservoir is below a predetermined value, and to move the dispensing head away from the neck when the internal pressure exceeds this predetermined value, so as to create a communication between the inside of the container and external atmosphere. In particular, the safety device returns into its initial leakproof position when the internal pressure of the container again falls below the predetermined value.

The dispensing head is advantageously provided with a dispensing valve having an actuating stem connected to a push button provided with a dispensing nozzle. This valve may be connected on the opposite side to the actuating stem to a deformable pouch containing the product to be dispensed or to a dip tube. When a deformable pouch is used, the product is subjected to the pressure of the propellant gas via this pouch.

In this case, the dispensing head provided with the pouch and the valve may constitute an interchangeable refill.

The dispensing nozzle is a simple dispensing orifice or a spray nozzle.

Preferably, the dispensing container of the invention takes the form of a sprayer producing a cloud of fine droplets or a filiform jet. The product to be dispensed is, in particular, a liquid product, viscous to a greater or lesser extent, or a gelled product. In this case, the dispensing nozzle is a liquid spray nozzle.

In a preferred manner, the safety device comprises a shroud joined to a retaining element slidably mounted for translation on the neck, which neck has an annular projection extending radially outwardly, the resiliently compressible annular means being placed between the neck and the projection and bearing against the retaining element.

Advantageously, the retaining element is a ring provided with fixing means cooperating with complementary fixing means carried by the shroud allowing the dispensing head to be fixed on the ring.

The annular resiliently compressible retaining means may be formed, for example, by a metal or plastic helical spring or by a cylindrical sleeve of an elastomeric material.

Advantageously, the dispensing head comprises a retaining collar sandwiched between the annular projection of the neck and an internal bearing surface of the shroud ensuring the seal with respect to the propellant gas.

In order to allow the container to be filled with propellant gas, the bottom of the container can be provided with an intake valve or filler valve for propellant gas. Thus there is obtained a dispensing container that is rechargeable with the product and/or the propellant gas. The container in accordance with the invention, rechargeable with the product and the propellant gas, constitutes an alternative to conventional dispensers that is both ecological and economic. Indeed, the conventional dispensing containers must be thrown away as a whole after use, and moreover, risk polluting the environment.

The propellant gas is advantageously chosen from the conventional propellants such as hydrocarbons, and the liquefiable chloro- or fluoro-hydrocarbons and compressible gases, such as compressed air, hydrogen, carbon dioxide etc.

According to a particular embodiment of the invention, the push button is pivotably mounted with a cover cap of which the shroud forms a part. This leads to a monobloc cover cap-shroud-push button assembly, which facilitates the assembly of this unit.

The present invention therefore provides for a pressurized container which contains a product to be dispensed and a propellant gas. The container comprises a closed reservoir, a cylindrical neck, a dispensing head mounted on the neck, and a safety device for preventing an accidental excess pressure inside the container. The safety device comprises annular resilient retaining means which surrounds the neck of the reservoir, and is capable of tightly gripping the dispensing head on the neck of the reservoir in a leakproof manner when an internal pressure of the reservoir is below a predetermined value, and when the internal pressure exceeds the predetermined value, of moving the dispensing head away from the neck so as to create a communication between an inside of the container and atmosphere.

BRIEF DESCRIPTION OF THE DRAWINGS

In describing the preferred embodiments of the present invention illustrated in the drawings, specified terminology is employed for the sake of clarity. However, the invention is not intended to be limited to the specific terminology so selected, and it is to be understood that each specific element includes all technical equivalents which operate for a similar purpose.

A more complete appreciation of the invention and many of the attendant advantages thereof will be readily obtained as the same becomes better understood by reference to the following detailed description when considered in connection with the accompanying drawings, wherein:

FIG. 1 is a schematic axial section of a dispensing container in accordance with the invention, the product to be dispensed being pressurized and being capable of being dispensed by means of a valve;

FIG. 2 shows an axial section, on an enlarged scale, of the encircled portion B of FIG. 1, when the internal pressure of the container is normal;

FIG. 3 shows an enlarged axial section of the encircled portion B of FIG. 1, when the container is under excess pressure; and FIG. 4 shows a section, similar to that of FIG. 2, of a variant of the embodiment.

DESCRIPTION OF THE PREFERRED EMBODIMENTS

Referring now to the drawings, wherein like reference numerals designate identical or corresponding parts throughout the several views, FIGS. 1 to 3 illustrate a dispensing container in accordance with the invention for liquid, which is designated by the reference numeral 1 as a whole.

The dispensing container 1 has a reservoir 2 of a cylindrical shape, having an axis of revolution A and provided with a concave bottom 3 comprising a one-way admission valve 9 for the propellant gas. In the example of the described embodiment, the reservoir 2 is made of an aluminium monobloc. In this embodiment, the valve 9 is formed in such a way that it can be connected to the outlet of an air compressor. On an end opposite to the bottom, the reservoir 2 has an ogive-shaped top 5 forming part of a dispensing head. The top 5 is extended in a cylindrical skirt 51 whose free end 51*a* is shaped as an annular bead. A seat 15, which carries a dispensing valve (valve body) 10, is fixed by crimping on this bead. The valve body 10 passes through the top 5, so that one of its ends 10*a* is located inside the reservoir 2. The end 10*a* is connected to a rigid annular collar 141 which forms part of a flexible pouch 14. In the vicinity of the end 10*a* of the valve 10, the top 5 has flexible fixing tabs 54 which serve to keep the collar 141 of the pouch 14 in position. The pouch contains a liquid or gelled product to be dispensed, for example, a hair lacquer. Advantageously, this lacquer has a low viscosity, for example, less than 1.5 Pa.s.

The valve 10 has, moreover, at its other end 10*b*, an emergent actuating and dispensing stem 11, on which a push button 12 is fixed. The push button 12 is provided with a dispensing orifice 13 (or a spray nozzle) which is connected to the actuating stem 11 of the valve 10 by an elbow dispensing duct 13*a*.

The top 5 is, moreover, provided with a cylindrical skirt 5*a*. The skirt 5*a* has, halfway up, an external annular retaining flange 53 whose function will be explained below.

The push button 12 and the top 5 are surrounded by a cover cap 8 which has a substantially cylindrical shape. This cap 8 has a side wall 83 called a shroud, and a dome 84. A cutout 85, provided in the transition zone between the wall 83 and the dome 84, allows the user to have access to the push button 12, with a view toward actuating the valve 10. Moreover, a passage orifice 86 in the side wall 83 is provided for the product to be dispensed, in a zone situated opposite the spray nozzle 13 (or dispensing orifice).

According to the invention, the cover cap 8 has a free bored end 81 with a thinner wall thickness than the rest of the cap 8 which is provided with an internal thread 81*a*. A setback 82 delimits the bored zone with a smaller thickness and defines an internal bearing surface in the shroud 83.

On the opposite side to the bottom 3, the reservoir 2 has a neck 4 whose diameter is slightly smaller than that of the rest of the reservoir 2. A ring 6, disposed on the neck 4, comprises an external thread 61 which is capable of cooperating with the internal thread 81 of the shroud 83. The ring 6 is mounted for free translation along the axis A. The free end of the neck 4 has an annular projection 41 extending radially outwardly. Between the projection 41 and the ring 6, resilient annular retaining means 7, 7*a* are disposed in compression. These means 7, 7*a* may be constituted by a metallic spiral (or helical spring) 7, or by a cylindrical spring 7*a* made of a resiliently compressible material (see FIG. 4).

Thus the flange 53 rests on the projection 41. On the side of the cap 8, the flange 53 bears against the setback 82. The free end 52 of the skirt 5*a* is thus fitted in the neck 4 of the reservoir 2.

It will be understood from the preceding description that the seal of the reservoir depends on the compression force of the means 7, 7*a*. Thus the sliding ring 6, the resilient retaining means 7, 7*a*, the projection 41 and the flange 53 constitute a gas discharging device which operates in the case of an accidental excess pressure and the operation thereof will be explained below. The compression force of the resilient retaining means 7, 7*a* is set according to the predetermined critical threshold pressure.

The assembly and the packaging of the dispensing container will be described below. First of all, a refill is made, comprising the flexible pouch 14, the valve 10, the top 5, the seat 15 and the push button 12. For this purpose, the pouch 14 is fixed on the valve 10, and the valve 10 is introduced into the top 5, the pouch 14 being held in position by the tags 54. By means of the seat 15, the valve 10 is then crimped on the skirt 51 of the top 5. The product to be dispensed is then injected into the pouch 14 through the stem 11 of the valve 10. Finally, the push button 12 is lowered onto the valve stem 11.

The refill thus obtained is then inserted into the neck 4 of the reservoir, taking care that the flange 53 is properly resting on the projection 41 of the neck of the reservoir. The cap 8 is then screwed onto the reservoir 2.

By means of a propellant gas source, such as an air compressor, an adequate quantity of gas is introduced through the valve 9, until the desired pressure, for example, $6.10^5$ Pa is obtained. Thus the dispenser is ready for use and the user can dispense the product by depressing the push button 12.

When the product has been completely used up, the user unscrews the cap 8 and places a new refill into position by proceeding as described above.

When the pressure of the propellant gas reaches a critical threshold value inside the reservoir 2, for example, by a rise in the ambient temperature due to the exposure of the container to a source of heat or during the loading with the propellant gas, the safety device of the dispenser becomes operational. Because of the internal excess pressure, the flange 53 of the top 5 moves away from the projection 41 by a distance d, as shown in FIG. 3. This entails a temporary leakage F of the propellant gas which is sufficient for the pressure to return below the predetermined critical threshold value. When the pressure becomes normal again, the resilient retaining means 7, 7*a* expand and come to apply the projection 41 against the flange 53. A fresh dispensing of the product can then be effected in absolute safety.

A variant of the embodiment of the invention has been represented in FIG. 4. In this variant, the helical spring 7 of FIG. 2 has been replaced by a cylindrical sleeve 7*a* made of a resiliently compressible rubber.

Due to the present invention, it is possible to store both the liquid to be dispensed and the propellant gas, separately and safely over a prolonged period without the risk of seeing it discharge to empty, or even burst, under the action of an accidental excess pressure.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters: Patent of the United States is:

1. A pressurized container containing a product to be dispensed and a propellant gas, the container comprising:

a closed reservoir; a cylindrical neck; a dispensing head mounted on the neck; and a safety device for preventing an accidental excess pressure inside the container;

wherein the safety device comprises:

annular resilient retaining means surrounding the neck of the reservoir, which is capable of tightly gripping the dispensing head on the neck of the reservoir in a leakproof manner when an internal pressure of the reservoir is below a predetermined value and, when the internal pressure exceeds said predetermined value, of moving said dispensing head away from the neck so as to create a communication between an inside of the container and atmosphere.

2. A container according to claim 1, wherein the resilient retaining means is a helical spring.

3. A container according to claim 1, wherein the resilient retaining means is a cylindrical rubber sleeve.

4. A container according to claim 1, wherein the container includes a closed bottom provided with an admission valve for the propellant gas.

5. A container according to claim 1, wherein the product is contained in a deformable pouch subjected to a pressure of the propellant gas.

6. A container according to claim 1, wherein the container is rechargeable with the product and with the propellant gas.

7. A container according to claim 1, wherein the propellant gas is compressed air.

8. A container according to claim 1, wherein the safety device includes a shroud joined to a retaining element slidably mounted for translation on the neck, the neck comprising an annular projection extending radially outwardly, the annular resilient retaining means being placed between the neck and the projection and bearing against the retaining element.

9. A container according to claim 8, wherein the dispensing head has a retaining flange sandwiched between the annular projection and an internal bearing surface cut into the shroud.

10. A container according to claim 8, wherein the retaining element is a ring provided with fixing means cooperating with complementary fixing means carried by the shroud, which allows the dispensing head to be fixed on the ring.

11. A container according to claim 10, wherein the fixing means and the complementary fixing means are each constituted by a screw thread.

12. A container according to claim 8, wherein the dispensing head is provided with a dispensing valve having an actuating stem connected to a push button provided with a dispensing nozzle.

13. A container according to claim 12, wherein the push button is pivotably mounted with a cover cap of which the shroud forms a part.

14. A container according to claim 12, wherein at an end opposite to the actuating stem, the valve is joined to a pouch containing the product and subjected to a pressure of the propellant gas.

15. A container according to claim 14, wherein the dispensing head, provided with the pouch and the valve, constitutes an interchangeable refill.

* * * * *